US011081074B2

(12) United States Patent
Huang

(10) Patent No.: US 11,081,074 B2
(45) Date of Patent: Aug. 3, 2021

(54) DRIVING CIRCUIT AND DISPLAY DRIVING DEVICE

(71) Applicant: HKC Corporation Limited, Guangdong (CN)

(72) Inventor: Xiaoyu Huang, Guangdong (CN)

(73) Assignee: HKC Corporation Limited, Guangdong (CN)

( * ) Notice: Subject to any disclaimer, the term of this patent is extended or adjusted under 35 U.S.C. 154(b) by 0 days.

(21) Appl. No.: 17/041,082

(22) PCT Filed: Nov. 29, 2018

(86) PCT No.: PCT/CN2018/118052

§ 371 (c)(1),
(2) Date: Sep. 24, 2020

(87) PCT Pub. No.: WO2020/087618

PCT Pub. Date: May 7, 2020

(65) Prior Publication Data

US 2021/0020132 A1 Jan. 21, 2021

(30) Foreign Application Priority Data

Oct. 29, 2018 (CN) ..... 201811269924.6

(51) Int. Cl.
*G09G 3/36* (2006.01)

(52) U.S. Cl.
CPC ... *G09G 3/3648* (2013.01); *G09G 2310/0248* (2013.01); *G09G 2310/0264* (2013.01); *G09G 2310/08* (2013.01)

(58) Field of Classification Search
None
See application file for complete search history.

(56) References Cited

U.S. PATENT DOCUMENTS 8,044,882 B1 10/2011 Fan
9,218,776 B2 12/2015 Jeon et al.
(Continued)

FOREIGN PATENT DOCUMENTS

CN 1317779 A 10/2001
CN 1779543 A 5/2006
(Continued)

OTHER PUBLICATIONS

International Search Report for Application No. PCT/CN2018/118052 dated Mar. 29, 2019, 3 pages.
(Continued)

*Primary Examiner* — Christopher J Kohlman
(74) *Attorney, Agent, or Firm* — Seyfarth Shaw LLP

(57) ABSTRACT

Provided are a driving circuit and a display driving device, comprising: when a signal processing module acts on any control signal, only the path of the display signal outputting to the sources of transistors in a portion of the corresponding sub-pixels is turned on, enabling this portion to complete the display of sub-pixels. At the same time, the reference voltage is connected to the reference voltage terminal of the other portion of the corresponding sub-pixels, so that the pixel electrode of the other portion is charged to the reference voltage. On such basis, before each control signal is inverted, a portion of the sub-pixels is in operation, and the other portion is precharged to the reference voltage, thereby improving the charging efficiency of the pixel electrodes, and ensuring that the voltage on the pixel electrodes can be switched to a target voltage.

20 Claims, 5 Drawing Sheets

(56) References Cited

U.S. PATENT DOCUMENTS

| | | | | |
|---|---|---|---|---|
| 9,524,685 | B2 | 12/2016 | Kim et al. | |
| 2016/0155404 | A1* | 6/2016 | Kim | G09G 3/3659 345/205 |
| 2017/0023833 | A1* | 1/2017 | No | G02F 1/134309 |

FOREIGN PATENT DOCUMENTS

| | | | |
|---|---|---|---|
| CN | 101814278 | A | 8/2010 |
| CN | 103943082 | A | 7/2014 |
| CN | 107103876 | A | 8/2017 |
| CN | 107507585 | A | 12/2017 |
| CN | 107622759 | A | 1/2018 |
| CN | 108279539 | A | 7/2018 |
| TW | 20137433 | A | 10/2010 |

OTHER PUBLICATIONS

Office Action for Application No. 20181129924.6 dated May 11, 2019, 5 pages.

* cited by examiner

DRIVING CIRCUIT AND DISPLAY DRIVING DEVICE

CROSS-REFERENCE TO RELATED APPLICATIONS

This application is a U.S. National Stage application of, and claims priority to, PCT/CN2018/118052, filed Nov. 29, 2018, which further claims priority to Chinese Patent Application No. 2018112699246, filed Oct. 29, 2018, the entire content of which is incorporated herein in its entirety.

TECHNICAL FIELD

The present disclosure relates to a driving circuit and display driving device.

BACKGROUND

A liquid crystal display (LCD) panel is a display device that is composed of a certain number of color pixels or black and white pixels and is placed in front of a light source or a reflective surface. In one of the embodiments, the thin film transistor liquid crystal display (TFT-LCD) is one of the main types of LCD flat panel display, and has become an important display platform in modern IT and video products. Taking the display drive of the TFT-LCD as an example, the system board transmits the R/G/B compressed signal and control signal and connects the power supply through a wire to the connector of the printed circuit board (PCB). The data is processed by the timing controller (TCON) and integrated circuit (IC) on the PCB, then transmitted to a display area by the source chip-on-film (S-COF) and the gate chip-on-film (G-COF). The voltages are transmitted by the data line and the scan line on the display array, enabling the TFT-LCD to achieve display functions. In one of the embodiments, signals that enable the TFT-LCD to achieve display functions include a row start signal of TCON output, a gate turn-on signal of the G-COF outputted to the gate of the transistor, and a display signal of the S-COF outputted to the source of the transistor.

Meanwhile, in the liquid crystal display panel, one sub-pixel is generally divided into two mutually independent portions, each of which includes one pixel electrode, and the sub-pixel display is realized by these two portions. Due to the material properties of the liquid crystal, setting the liquid crystal on the same voltage for a long time causes polarization of the liquid crystal, causing display abnormality. Therefore, the TFT-LCD requires a reference voltage during display, and then a voltage value higher than the reference voltage is defined as a positive polarity, and a voltage value lower than the reference voltage is defined as a negative polarity. During the display process, the voltage set on the liquid crystal is switched between positive polarity and negative polarity every frame to avoid liquid crystal polarization. Since the charging time is insufficient, the voltage on the pixel electrode is directly switched from the positive polarity to the negative polarity, and the voltage difference is large, which may cause insufficient charging, that is, the voltage on the pixel electrode cannot be switched to the target voltage within a limited charging time.

SUMMARY

According to various embodiments of present disclosure, a driving circuit and display driving device are provided.

A driving circuit includes a signal processing circuit and controlled switching circuits. Each of the controlled switching circuits corresponds to each sub-pixel, respectively. The signal processing circuit is configured to access a row start signal of a timing controller, and output a control signal according to the row start signal. The controlled switching circuit includes a display switching circuit and a reference switching circuit. An input terminal of the display switching circuit is configured to access a display signal outputted by a source chip-on-film, and a controlled terminal of the display switching circuit is configured to access the control signal, a first output terminal of the display switching circuit is connected to a source of a transistor corresponding to a first portion of the sub-pixel, and a second output terminal of the display switching circuit is connected to a source of a transistor corresponding to a second portion of the sub-pixel. An input terminal of the reference switching circuit is configured to access a reference voltage, and a controlled terminal of the reference switching circuit is configured to access the control signal, a first output terminal of the reference switching circuit is connected to a reference voltage terminal corresponding to a first portion of the sub-pixel, and a second output terminal of the reference switching circuit is connected to a reference voltage terminal corresponding to a second portion of the sub-pixel. The control signal causes the display switching circuit to be turned on with the input terminal and the first output terminal thereof being connected, and causes the reference switching circuit to be turned on with the input terminal and the second output terminal thereof being connected; or, the control signal causes the display switching circuit to be turned on with the input terminal and the second output terminal thereof being connected, and causes the reference switching circuit to be turned on with the input terminal and the first output terminal thereof being connected.

In one of the embodiments, the signal processing circuit includes a D flip-flop, a first controlled switch, and a second controlled switch. An input terminal of the first controlled switch is configured to access a logic high level voltage, and an input terminal of the second controlled switch is grounded. An output terminal of the first controlled switch is configured to access an output terminal of the second controlled switch and is grounded, and the output terminal of the first controlled switch is further configured to output the control signal. A controlling terminal of the D flip-flop is configured to access the row start signal, an pulse input terminal of the D flip-flop is connected to the output terminal of the first controlled switch, and an output terminal of the D flip-flop is connected to a controlled terminal of the first controlled switch and a controlled terminal of the second controlled switch. Upon the output terminal of the D flip-flop outputting a same logic level voltage, the first controlled switch is turned on with the input terminal and the output terminal thereof being connected, and the second controlled switch is turned off with the input terminal and the output terminal thereof being disconnected; or, the first controlled switch is turned off with the input terminal and the output terminal thereof being disconnected, and the second controlled switch is turned on with the input terminal and the output terminal thereof being connected.

In one of the embodiments, the D flip-flop includes a rising edge D flip-flop.

In one of the embodiments, the first controlled switch includes a first P-channel field effect transistor (FET), and the second controlled switch includes a first N-channel FET. A controlled terminal of the first controlled switch is a gate of the first P-channel FET; and a controlled terminal of the second controlled switch is a gate of the first N-channel FET.

In one of the embodiments, the signal processing circuit further includes a protective resistor. The output terminal of the first controlled switch is grounded through the protective resistor.

In one of the embodiments, the display switching circuit includes a third controlled switch and a fourth controlled switch. A controlled terminal of the third controlled switch and a controlled terminal of the fourth controlled switch access the control signal; an input terminal of the third controlled switch and an input terminal of the fourth controlled switch are the input terminals of the display switching circuit, an output terminal of the third controlled switch is the first output terminal of the display switching circuit, and an output terminal of the fourth controlled switch is the second output terminal of the display switching circuit; and upon the controlled terminals receiving the same control signal, the third controlled switch is turned on with the input terminal and the output terminal thereof being connected, and the fourth controlled switch is turned off with the input terminal and the output terminal thereof being disconnected; or, the third controlled switch is turned off with the input terminal and the output terminal thereof being disconnected, and the fourth controlled switch is turned on with the input terminal and the output terminal thereof being connected.

In one of the embodiments, the third controlled switch includes a second N-channel FET, and the fourth controlled switch includes a second P-channel FET. A controlled terminal of the third controlled switch is a gate of the second N-channel FET; and a controlled terminal of the fourth controlled switch is a gate of the second P-channel FET.

In one of the embodiments, the reference switching circuit includes a fifth controlled switch and a sixth controlled switch. A controlled terminal of the third controlled switch and a controlled terminal of the fourth controlled switch access the control signal; an input terminal of the fifth controlled switch and an input terminal of the sixth controlled switch are the input terminals of the reference switching circuit, an output terminal of the fifth controlled switch is the first output terminal of the reference switching circuit, and an output terminal of the sixth controlled switch is the second output terminal of the reference switching circuit; and upon the controlled terminals receiving the same control signal, the fifth controlled switch is turned on with the input terminal and the output terminal thereof being connected, and the sixth controlled switch is turned off with the input terminal and the output terminal thereof being disconnected; or, the fifth controlled switch is turned off with the input terminal and the output terminal thereof being disconnected, and the sixth controlled switch is turned on with the input terminal and the output terminal thereof being connected.

In one of the embodiments, the fifth controlled switch includes a second P-channel FET, and the sixth controlled switch includes a second N-channel FET. A controlled terminal of the fifth controlled switch is a gate of the second P-channel FET; and a controlled terminal of the sixth controlled switch is a gate of the second N-channel FET.

A display driving device includes a timing controller, a source chip-on-film, a gate chip-on-film, and a driving circuit; the timing controller is connected to the source chip-on-film and the gate chip-on-film, respectively. The driving circuit includes a signal processing circuit and controlled switching circuits. Each of the controlled switching circuits corresponds to each sub-pixel, respectively. The signal processing circuit accesses a row start signal of a timing controller, and output a control signal according to the row start signal. The controlled switching circuit includes a display switching circuit and a reference switching circuit. An input terminal of the display switching circuit is configured to access a display signal outputted by a source chip-on-film, and a controlled terminal of the display switching circuit is configured to access the control signal, a first output terminal of the display switching circuit is connected to a source of a transistor corresponding to a first portion of the sub-pixel, and a second output terminal of the display switching circuit is connected to a source of a transistor corresponding to a second portion of the sub-pixel. An input terminal of the reference switching circuit is configured to access a reference voltage, and a controlled terminal of the reference switching circuit is configured to access the control signal, a first output terminal of the reference switching circuit is connected to a reference voltage terminal corresponding to a first portion of the sub-pixel, and a second output terminal of the reference switching circuit is connected to a reference voltage terminal corresponding to a second portion of the sub-pixel. The gate chip-on-film is configured to connect to the gates of transistors of both portions of each of the sub-pixels. The control signal causes the display switching circuit to be turned on with the input terminal and the first output terminal thereof being connected, and causes the reference switching circuit to be turned on with the input terminal and the second output terminal thereof being connected; or, the control signal causes the display switching circuit to be turned on with the input terminal and the second output terminal thereof being connected, and causes the reference switching circuit to e turned on with the input terminal and the first output terminal thereof being connected.

In one of the embodiments, the signal processing circuit includes a D flip-flop, a first controlled switch, and a second controlled switch. An input terminal of the first controlled switch is configured to access a logic high level voltage, and an input terminal of the second controlled switch is grounded. An output terminal of the first controlled switch is connected to an output terminal of the second controlled switch and is grounded, and the output terminal of the first controlled switch is further configured to output the control signal. A controlling terminal of the D flip-flop is configured to access the row start signal, an pulse input terminal of the D flip-flop is connected to the output terminal of the first controlled switch, and an output terminal of the D flip-flop is connected to a controlled terminal of the first controlled switch and a controlled terminal of the second controlled switch. Upon the output terminal of the D flip-flop outputting a same logic level voltage, the first controlled switch is turned on with the input terminal and the output terminal thereof being connected, and the second controlled switch is turned off with the input terminal and the output terminal thereof being disconnected; or, the first controlled switch is turned off with the input terminal and the output terminal thereof being disconnected, and the second controlled switch is turned on with the input terminal and the output terminal thereof being connected.

In one of the embodiments, the D flip-flop includes a rising edge D flip-flop.

In one of the embodiments, the first controlled switch includes a first P-channel FET, and the second controlled switch includes a first N-channel FET. A controlled terminal of the first controlled switch is a gate of the first P-channel FET; and a controlled terminal of the second controlled switch is a gate of the first N-channel FET.

In one of the embodiments, the signal processing circuit further includes a protective resistor. The output terminal of the first controlled switch is grounded through the protective resistor.

In one of the embodiments, the display switching circuit includes a third controlled switch and a fourth controlled switch. A controlled terminal of the third controlled switch and a controlled terminal of the fourth controlled switch access the control signal; an input terminal of the third controlled switch and an input terminal of the fourth controlled switch are the input terminals of the display switching circuit, an output terminal of the third controlled switch is the first output terminal of the display switching circuit, and an output terminal of the fourth controlled switch is the second output terminal of the display switching circuit; and upon the controlled terminals receiving the same control signal, the third controlled switch is turned on with the input terminal and the output terminal thereof being connected, and the fourth controlled switch is turned off with the input terminal and the output terminal thereof being disconnected; or, the third controlled switch is turned off with the input terminal and the output terminal thereof being disconnected, and the fourth controlled switch is turned on with the input terminal and the output terminal thereof being connected.

In one of the embodiments, the third controlled switch includes a second N-channel FET, and the fourth controlled switch includes a second P-channel FET. A controlled terminal of the third controlled switch is a gate of the second N-channel FET; and a controlled terminal of the fourth controlled switch is a gate of the second P-channel FET.

In one of the embodiments, the reference switching circuit includes a fifth controlled switch and a sixth controlled switch. A controlled terminal of the third controlled switch and a controlled terminal of the fourth controlled switch access the control signal; an input terminal of the fifth controlled switch and an input terminal of the sixth controlled switch are the input terminals of the reference switching circuit, an output terminal of the fifth controlled switch is the first output terminal of the reference switching circuit, and an output terminal of the sixth controlled switch is the second output terminal of the reference switching circuit; and upon the controlled terminals receiving the same control signal, the fifth controlled switch is turned on with the input terminal and the output terminal thereof being connected, and the sixth controlled switch is turned off with the input terminal and the output terminal thereof being disconnected; or, the fifth controlled switch is turned off with the input terminal and the output terminal thereof being disconnected, and the sixth controlled switch is turned on with the input terminal and the output terminal thereof being connected.

In one of the embodiments, the fifth controlled switch includes a second P-channel FET, and the sixth controlled switch includes a second N-channel FET. A controlled terminal of the fifth controlled switch is a gate of the second P-channel FET; and a controlled terminal of the sixth controlled switch is a gate of the second N-channel FET. A display device includes a display driving device, a backlight panel, and display array. The display driving device includes a timing controller, a source chip-on-film, a gate chip-on-film, and a driving circuit; wherein the timing controller is connected to the source chip-on-film and the gate chip-on-film, respectively. The driving circuit includes a signal processing circuit and controlled switching circuits. Each of the controlled switching circuits corresponds to each sub-pixel, respectively. The signal processing circuit accesses a row start signal of a timing controller, and output a control signal according to the row start signal. The controlled switching circuit includes a display switching circuit and a reference switching circuit. An input terminal of the display switching circuit is configured to access a display signal outputted by a source chip-on-film, and a controlled terminal of the display switching circuit is configured to access the control signal, a first output terminal of the display switching circuit is connected to a source of a transistor corresponding to a first portion of the sub-pixel, and a second output terminal of the display switching circuit is connected to a source of a transistor corresponding to a second portion of the sub-pixel. An input terminal of the reference switching circuit is configured to access a reference voltage, and a controlled terminal of the reference switching circuit is configured to access the control signal, a first output terminal of the reference switching circuit is connected to a reference voltage terminal corresponding to a first portion of the sub-pixel, and a second output terminal of the reference switching circuit is connected to a reference voltage terminal corresponding to a second portion of the sub-pixel. The gate chip-on-film is configured to connect to the gates of transistors of both portions of each of the sub-pixels. The control signal causes the display switching circuit to be turned on with the input terminal and the first output terminal thereof being connected, and causes the reference switching circuit to be turned on with the input terminal and the second output terminal thereof being connected; or, the control signal causes the display switching circuit to be turned on with the input terminal and the second output terminal thereof being connected, and causes the reference switching circuit to be turned on with the input terminal and the first output terminal thereof being connected. The display array is connected to the source chip-on-film and the gate chip-on-film, respectively. The backlight panel is configured to provide a light source to the display array.

In one of the embodiments, the display array comprises a liquid crystal display array.

The details of one or more embodiments of present disclosure are set forth in the accompanying drawings and the description below. Other features and advantages of present disclosure will be apparent from the description and drawings, and from the claims.

BRIEF DESCRIPTION OF THE DRAWINGS

To illustrate the technical solutions according to the embodiments of the present disclosure or in the prior art more clearly, the accompanying drawings for describing the embodiments or the prior art are introduced briefly in the following. Apparently, the accompanying drawings in the following description are only some embodiments of the present disclosure, and persons of ordinary skill in the art can derive other drawings from the accompanying drawings without creative efforts.

DETAILED DESCRIPTION OF THE EMBODIMENTS

Embodiments of the present disclosure are described more fully hereinafter with reference to the accompanying drawings, in which some embodiments of the present disclosure are shown. The various embodiments of the present disclosure may, however, be embodied in many different forms and should not be construed as limited to the embodiments set forth herein.

Embodiments of the present disclosure provide a driving circuit.

Figure 1:
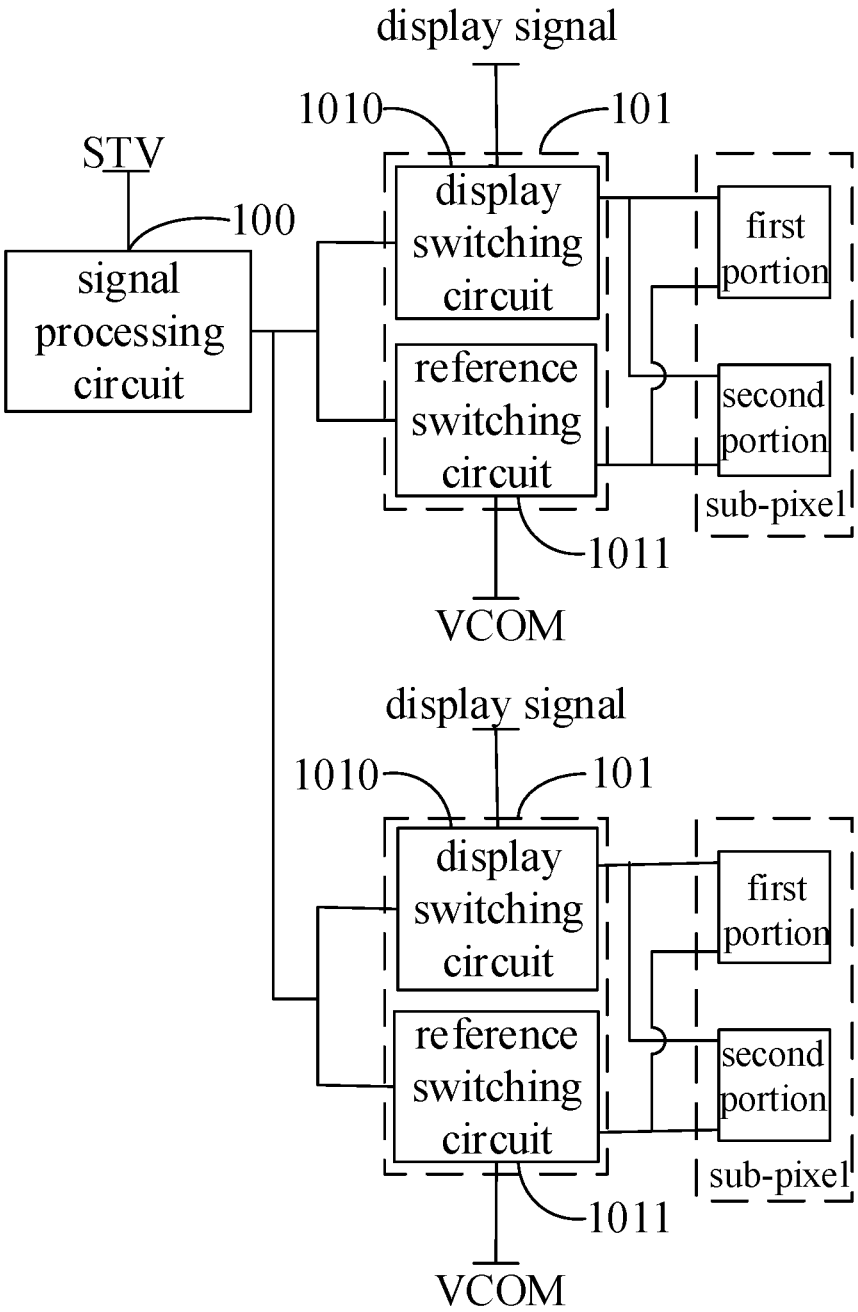
FIG. 1 is a circuit diagram of a driving circuit according to one or more embodiments.

FIG. 1 is a circuit diagram of a driving circuit according to one or more embodiments. As shown in FIG. 1, a driving circuit according to an embodiment includes a signal processing circuit 100 and controlled switching circuits 101. In one of the embodiments, each of the controlled switching circuits 101 corresponds to each sub-pixel, respectively.

The signal processing circuit 100 is configured to access a row start signal STV of a timing controller, and output a control signal according to the row start signal STV.

In one of the embodiments, the row start signals STV are a signals in the form of a pulse, that is, the line start signals STV are pulse signals one after another. When the signal processing circuit 100 receives one row start signal STV, signal processing circuit 100 outputs a control signal according to the row start signal STV. When the signal processing circuit 100 receives the next row start signal STV, signal processing circuit 100 outputs another control signal according to the new row start signal STV, so as to replace the old control signal.

Figure 2:
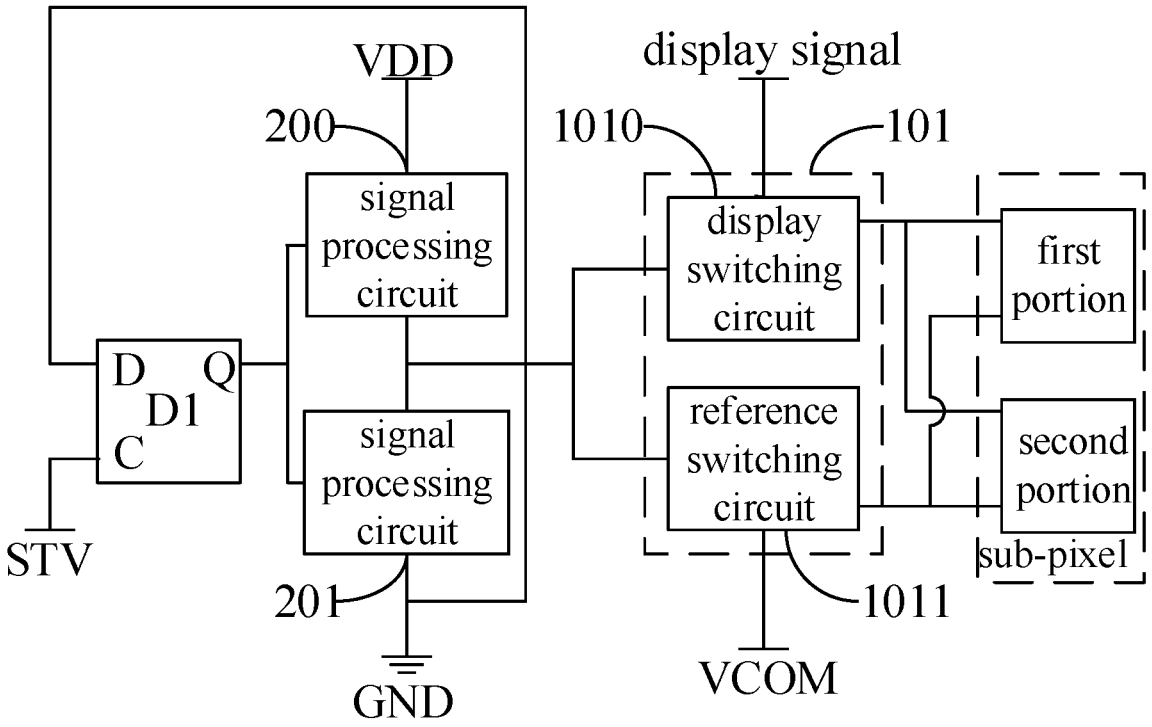
FIG. 2 is a circuit diagram of another driving circuit according to one or more embodiments.

In one of the embodiments, FIG. 2 is a circuit diagram of another driving circuit according to one or more embodiments. As shown in FIG. 2, the signal processing circuit includes a D flip-flop D1, a first controlled switch 200, and a second controlled switch 201.

An input terminal of the first controlled switch 200 is configured to access a logic high level voltage VDD, and an output terminal of the second controlled switch 201 is connect to the ground GND.

An output terminal of the first controlled switch 200 is configured to connect to an output terminal of the second controlled switch 201, and is connected to the ground GND, the output terminal of the first controlled switch 200 is further configured to output the control signal.

A controlling terminal C of the D flip-flop D1 is configured to access the row start signal STV, an pulse input terminal D of the D flip-flop D1 is connected to the output terminal of the first controlled switch 200, and an output terminal Q of the D flip-flop D1 is connected to a controlled terminal of the first controlled switch 200 and a controlled terminal of the second controlled switch 201.

In one of the embodiments, when the D flip-flop D1 receives a row start signal STV, it assigns the logic potential value received from the pulse input terminal D to the output terminal Q.

In one of the embodiments, the D flip-flop D1 includes a rising edge D flip-flop.

In one of the embodiments, the rising edge D flip-flop is employed, that is, when the row start signal STV is received, the value assignment is flip-flopped according to the rising edge of the row start signal STV, so as to better adapt to the characteristics of the row start signal STV.

In one of the embodiments, upon the output terminal of the D flip-flop D1 outputting a same logic level voltage, the input terminal and the output terminal of the first controlled switch 200 are electrically connected, and the input terminal and the output terminal of the second controlled 201 switch are electrically disconnected; or, the input terminal and the output terminal of the first controlled switch 200 are electrically disconnected, and the input terminal and the output terminal of the second controlled switch 201 are electrically connected.

In one of the embodiments, the logic level outputted from the output terminal of the D flip-flop D is unique. In the unique logic level, the first controlled switch 200 and the second controlled switch 201 are alternatively turned on, that is, only the input and output terminals of the first controlled switch 200 are electrically connected, or only the input and output terminals of the first controlled switch 200 are electrically connected, and the other terminals are electrically disconnected. In one of the embodiments, if the input and output terminals of the first controlled switch 200 are electrically connected, then the control signal is the logic high level voltage VDD. If the input and output terminals of the second controlled switch 201 are electrically connected, then the control signal is the ground potential, i.e., a logic low level voltage.

The following describes the processes of the signal processing circuit 100 with the D flip-flop D1 including a rising edge D flip-flop.

In an initial state, since the output terminal of the first controlled switch 200 is grounded, the control signal is a logic low level voltage. That is, the pulse input terminal D of the D flip-flop D1 is at a logic low level voltage.

When the first row start signal STV arrives, the value of pulse input terminal D of the D flip-flop D1 is assigned to the output terminal Q, and at this time, the output terminal Q outputs a logic low level voltage, and the first controlled switch 200 is turned on, the second controlled switch 101 is turned off. At this time, the control signal is a logic high level voltage. At this time, the output terminal D of the D flip-flop D1 is at the logic high level voltage.

When the next row start signal STV arrives, the value of pulse input terminal D of the D flip-flop D1 is assigned to the output terminal Q, and at this time, the output terminal Q outputs a logic high level voltage, and the second controlled switch 201 is turned on, the first controlled switch 100 is turned off. At this time, the control signal is a logic low level voltage. At this time, the output terminal D of the D flip-flop D1 is at the logic low level voltage.

Then the processes are circled repeatedly.

In one of the embodiments, the first controlled switch 200 and the second controlled switch 201 include three-terminal switching elements such as an electronic switch or a FET.

Figure 3:
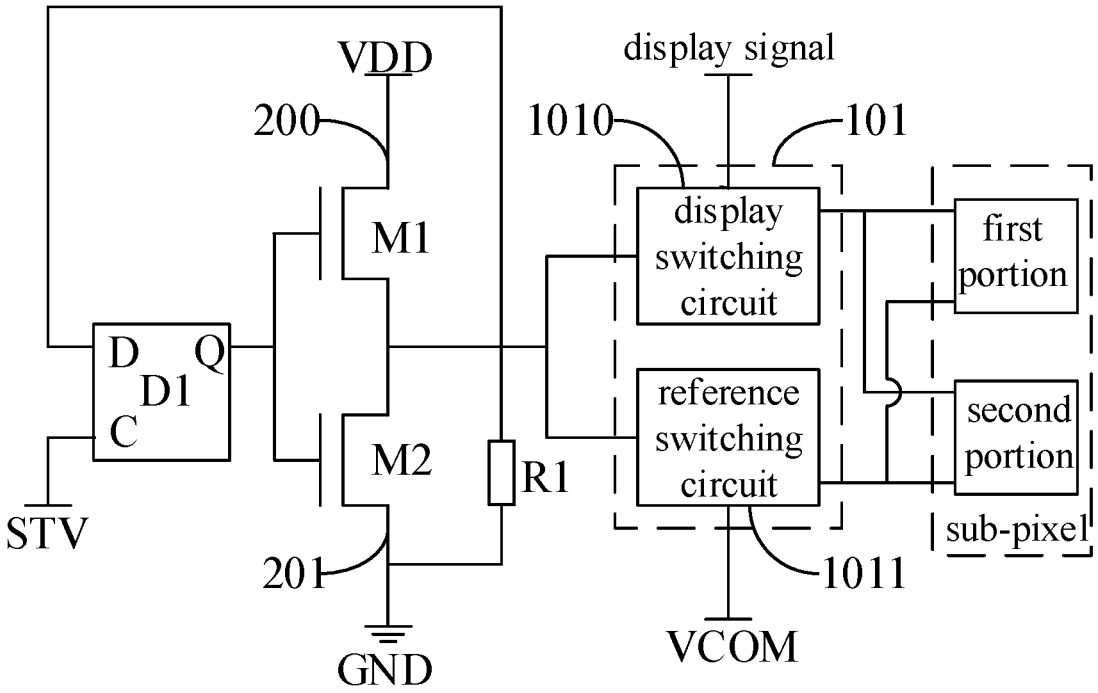
FIG. 3 is a schematic diagram of a driving circuit according to one or more embodiments.

In one of the embodiments, FIG. 3 is a schematic diagram of a driving circuit according to one or more embodiments. As shown in FIG. 3, the first controlled switch 200 includes a first P-channel FET M1, and the second controlled switch 201 includes a first N-channel FET M2.

A controlled terminal of the first controlled switch 200 is a gate of the first P-channel FET M1; and a controlled terminal of the second controlled switch 201 is a gate of the first N-channel FET M2.

In one of the embodiments, as shown in FIG. 3, the gate of the first P-channel FET M1 is turned on when receiving a logic low level voltage, and vice versa. The gate of the first N-channel FET M2 is turned on when receiving a logic high level voltage, and vice versa. Accordingly, an alternative turning on of the first controlled switch 200 and the second controlled switch 201 is achieved.

The controlled switching circuit 101 includes a display switching circuit 1010 and a reference switching circuit 1011.

An input terminal of the display switching circuit 1010 is configured to access a display signal outputted by a source chip-on-film, and a controlled terminal of the display switching circuit 1010 is configured to access the control signal, a first output terminal of the display switching circuit 1010 is connected to a source of a transistor corresponding to a first portion of the sub-pixel, and a second output terminal of the display switching circuit 1010 is connected to a source of a transistor corresponding to a second portion of the sub-pixel.

In one of the embodiments, the display switching circuit 1010 is configured to be turned on with its input terminal and the first output terminal being connected, or to be turned on with its input terminal and second output terminal being connected in accordance with the received control signal. In one of the embodiments, at any time, the display switching circuit 1010 is turned on with its input terminal being electrically connected to only one of the output terminals, that is, the output terminals are alternatively connected. When the input terminal and the first output terminal are connected, the display signal outputted by the source chip-on-film is transmitted to the source of the transistor corresponding to a first portion of the sub-pixel, and when the gate of the transistor corresponding to the first portion receives the gate turn-on signal, the pixel electrode corresponding to the first portion of the sub-pixel is charged on for display. When the input terminal and the second output terminal are electrically connected, the display signal outputted by the source chip-on-film is transmitted to the source of the transistor corresponding to a second portion of the sub-pixel, and when the gate of the transistor corresponding to the second portion receives the gate turn-on signal, the pixel electrode corresponding to the second portion of the sub-pixel is charged on for display.

In one of the embodiments, as shown in FIG. 3, the signal processing circuit 100 further includes a protective resistor R1.

The output terminal of the first controlled switch 200 is grounded through the protective resistor R1.

The output terminal of the first controlled switch 200 is prevented from being short-circuited to the ground by the protection resistor R1.

Figure 4:
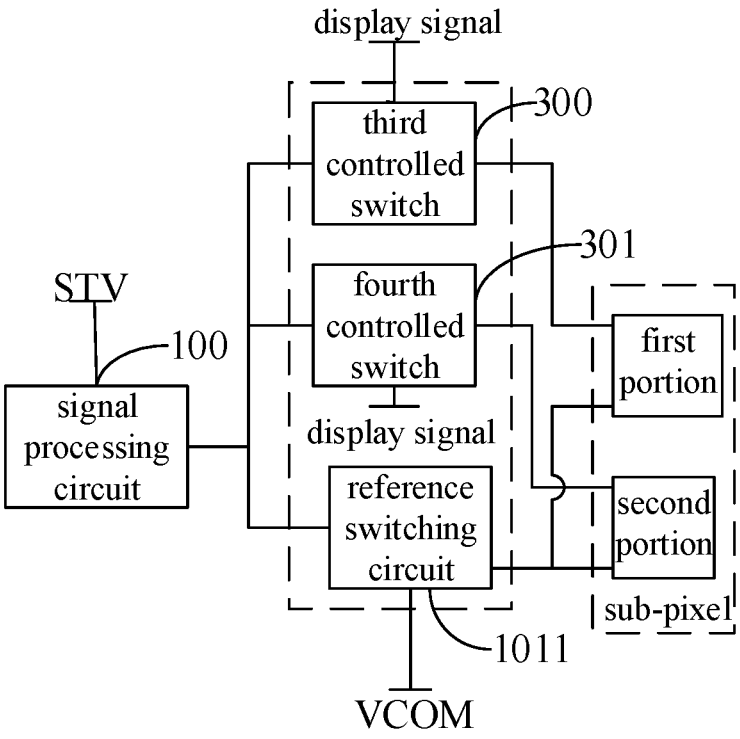
FIG. 4 is a circuit diagram of another driving circuit according to one or more embodiments.

In one of the embodiments, FIG. 4 is a circuit diagram of another driving circuit according to one or more embodiments. As shown in FIG. 4, the display switching circuit includes a third controlled switch 300 and a fourth controlled switch 301.

A controlled terminal of the third controlled switch 300 and a controlled terminal of the fourth controlled switch 301 access the control signal.

An input terminal of the third controlled switch 300 and an input terminal of the fourth controlled switch 301 are the input terminals of the display switching circuit 1010, an output terminal of the third controlled switch 300 is the first output terminal of the display switching circuit 1010, and an output terminal of the fourth controlled switch 301 is the second output terminal of the display switching circuit 1010.

In one of the embodiments, upon the controlled terminals receiving the same control signal, the input terminal and the output terminal of the third controlled switch 300 are electrically connected, and the input terminal and the output terminal of the fourth controlled switch 301 are electrically disconnected; or, the input terminal and the output terminal of the third controlled switch 300 are electrically disconnected, and the input terminal and the output terminal of the fourth controlled switch 301 are electrically connected.

In one of the embodiments, upon the controlled terminals receiving any control signal, the third controlled switch 300 and the fourth controlled switch 301 are alternatively turned on, that is, at any time, either the input terminal and the output terminal of the third controlled switch 300 are electrically connected or the input terminal and the output terminal of the fourth controlled switch 301 are electrically connected. Accordingly, an alternative turning on of the display switching circuit 1010 is achieved.

Figure 5:
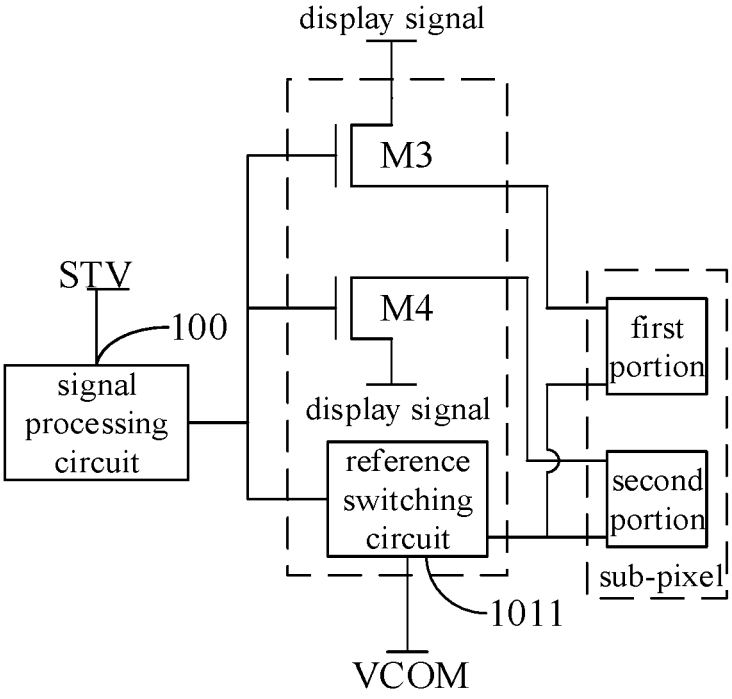
FIG. 5 is another schematic diagram of a driving circuit according to one or more embodiments.

In one of the embodiments, FIG. 5 is another schematic diagram of a driving circuit according to one or more embodiments. As shown in FIG. 5, the third controlled switch 300 includes a second N-channel FET M3, and the fourth controlled switch 301 includes a second P-channel FET M4.

A controlled terminal of the third controlled switch 300 is a gate of the second N-channel FET M3; and a controlled terminal of the fourth controlled switch 301 is a gate of the second P-channel FET M4.

In one of the embodiments, as shown in FIG. 5, the gate of the second P-channel FET M4 is turned on when receiving a logic low level voltage, and vice versa. The gate of the second N-channel FET M3 is turned on when receiving a logic high level voltage, and vice versa. Accordingly, an alternative turning on of the third controlled switch 300 and the fourth controlled switch 301 is achieved.

An input terminal of the reference switching circuit 1011 is configured to access a reference voltage VCOM, and a controlled terminal of the reference switching circuit 1011 is configured to access the control signal, a first output terminal of the reference switching circuit 1011 is connected to a reference voltage terminal corresponding to a first portion of the sub-pixel, and a second output terminal of the reference switching circuit 1011 is connected to a reference voltage terminal corresponding to a second portion of the sub-pixel.

In one of the embodiments, the reference switching circuit 1011 is configured to be turned on with its input terminal and the first output terminal being electrically connected, or to be turned on with its input terminal and second output terminal being electrically connected in accordance with the received control signal. In one of the embodiments, at any time, the reference switching circuit 1011 is turned on with its input terminal being electrically connected to only one of the output terminals, that is, the output terminals are alternatively connected. When the input terminal and the first output terminal are electrically connected, a reference voltage terminal corresponding to a first portion of the sub-pixel receives the reference voltage VCOM, and the pixel electrode corresponding to the first portion of the sub-pixel is charged to the reference voltage VCOM. When the input terminal and the second output terminal are electrically connected, a reference voltage terminal corresponding to a second portion of the sub-pixel receives the reference voltage VCOM, and the pixel electrode corresponding to the second portion of the sub-pixel is charged to the reference voltage VCOM.

Figure 6:
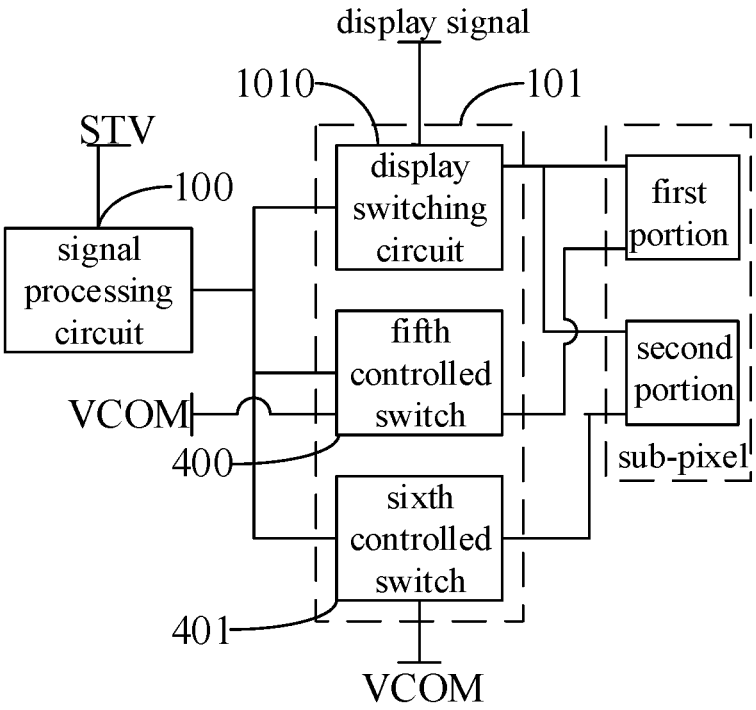
FIG. 6 is a circuit diagram of yet another driving circuit according to one or more embodiments.

In one of the embodiments, FIG. 6 is a circuit diagram of another driving circuit according to one or more embodiments. As shown in FIG. 6, the reference switching circuit 1011 includes a fifth controlled switch 400 and a sixth controlled switch 401.

A controlled terminal of the fifth controlled switch 400 and a controlled terminal of the sixth controlled switch 401 access the control signal.

An input terminal of the fifth controlled switch 400 and an input terminal of the sixth controlled switch 401 are the input terminals of the reference switching circuit 1011, an output terminal of the fifth controlled switch 400 is the first output terminal of the reference switching circuit 1011, and an output terminal of the sixth controlled switch 401 is the second output terminal of the reference switching circuit 1011.

In one of the embodiments, upon the controlled terminals receiving the same control signal, the fifth controlled switch 400 is turned on with the input terminal and the output terminal thereof being connected, and the sixth controlled switch 401 is turned off with the input terminal and the output terminal thereof being disconnected; or, the fifth controlled switch 400 is turned off with the input terminal and the output terminal thereof being disconnected, and the sixth controlled switch 401 is turned on the input terminal and the output terminal thereof being connected.

Figure 7:
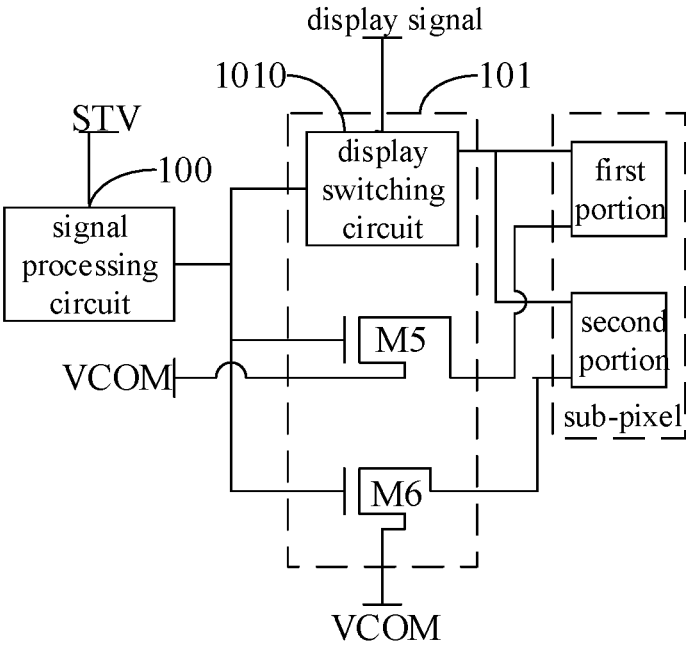
FIG. 7 is a schematic diagram of a another driving circuit according to one or more embodiments.

In one of the embodiments, FIG. 7 is another schematic diagram of a driving circuit according to one or more embodiments. As shown in FIG. 7, the fifth controlled switch 400 includes a third P-channel FET M5, and the sixth controlled switch 401 includes a third N-channel FET M6.

A controlled terminal of the fifth controlled switch 400 is a gate of the third P-channel FET M5.

A controlled terminal of the sixth controlled switch 401 is a gate of the third N-channel FET M6.

In one of the embodiments, as shown in FIG. 7, the gate of the third P-channel FET M5 is turned on when receiving a logic low level voltage, and vice versa. The gate of the third N-channel FET M6 is turned on when receiving a logic high level voltage, and vice versa. Accordingly, an alternative turning on of the fifth controlled switch 400 and the sixth controlled switch 401 is achieved.

In one of the embodiments, the control signal causes the display switching circuit 1010 to be turned on with the input terminal and the first output terminal thereof being connected, and causes the reference switching circuit 1011 to be turned on with the input terminal and the second output terminal thereof being connected; or, the control signal causes the display switching circuit 1010 to be turned on with the input terminal and the second output terminal thereof being connected, and causes the reference switching circuit 1011 to be turned on with the input terminal and the first output terminal thereof being connected.

A display driving device is also provided in the present disclosure.

Figure 8:
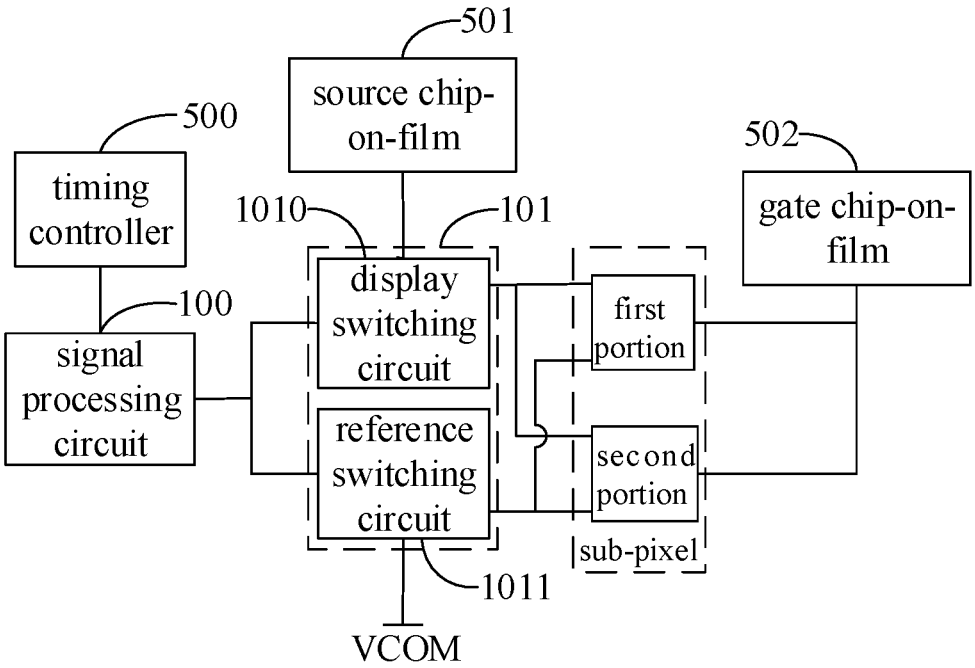
FIG. 8 is a schematic diagram of a display driving device according to one or more embodiments.

FIG. 8 is a schematic diagram of a display driving device according to one or more embodiments. As shown in FIG. 8, a display driving device according to an embodiment includes a timing controller 500, a source chip-on-film 501, a gate chip-on-film 502, and a driving circuit 503. In one of the embodiments, the timing controller 500 is connected to the source chip-on-film 501 and the gate chip-on-film 502, respectively.

The driving circuit 503 includes a signal processing circuit 100 and controlled switching circuits 101. In one of the embodiments, each of the controlled switching circuits 101 corresponds to each sub-pixel, respectively.

The signal processing circuit accesses a row start signal STV of a timing controller 500, and output a control signal according to the row start signal.

The controlled switching circuit 101 includes a display switching circuit 1010 and a reference switching circuit 1011.

An input terminal of the display switching circuit 1010 accesses a display signal outputted by a source chip-on-film 501, and a controlled terminal of the display switching circuit 1010 is configured to access the control signal, a first output terminal of the display switching circuit 1010 is connected to a source of a transistor corresponding to a first portion of the sub-pixel, and a second output terminal of the display switching circuit 1010 is connected to a source of a transistor corresponding to a second portion of the sub-pixel.

An input terminal of the reference switching circuit 1011 is configured to access a reference voltage VCOM, and a controlled terminal of the reference switching circuit 1011 is configured to access the control signal, a first output terminal of the reference switching circuit 1011 is connected to a reference voltage terminal corresponding to a first portion of the sub-pixel, and a second output terminal of the reference switching circuit 1011 is connected to a reference voltage terminal corresponding to a second portion of the sub-pixel.

The gate chip-on-film 502 is configured to connect to the gates of transistors of both portions of each of the sub-pixels.

In one of the embodiments, the control signal causes the display switching circuit 1010 to be turned on with the input terminal and the first output terminal thereof being connected, and causes the reference switching circuit 1011 to be turned on with the input terminal and the second output terminal thereof being connected; or, the control signal causes the display switching circuit 1010 to be turned on with the input terminal and the second output terminal thereof being connected, and causes the reference switching circuit 1011 to be turned on with the input terminal and the first output terminal thereof being connected.

According to the aforementioned driving circuit and display driving device, the signal processing circuit 100 outputs a control signal according to a row start signal STV. When any control signal is active, the display signal is only conducted to the source of the transistor of corresponding to a portion of sub-pixel, such that this portion achieves the display of the sub-pixel. At the same time, a reference voltage VCOM is inputted into a reference voltage terminal corresponding to the other portion of the sub-pixel, such that the other portion of the pixel electrode is charged to the reference voltage VCOM. When the control signal next to the aforementioned control signal is active, the pixel electrode which is pre-charged to the reference voltage VCOM can finish charging quickly, and the pixel electrode of the portion of the sub-pixel that was used for display in the former control signal's action is charged to the reference voltage VCOM. Accordingly, before each time the control signal is turned over, a portion of the sub-pixel is in operation, and another portion is pre-charged to the reference voltage VCOM, thereby improving the charging efficiency of the pixel electrode, and ensuring that the voltage on the pixel electrode can be switched to the target voltage.

A display device is also provided in the present disclosure.

A display device includes a display driving device, a backlight panel, and display array.

The display driving device includes a timing controller, a source chip-on-film, a gate chip-on-film, and a driving circuit; the timing controller is connected to the source chip-on-film and the gate chip-on-film, respectively.

The driving circuit includes a signal processing circuit and controlled switching circuits. Each of the controlled switching circuits corresponds to each sub-pixel, respectively.

The signal processing circuit accesses a row start signal of a timing controller, and output a control signal according to the row start signal.

The controlled switching circuit includes a display switching circuit and a reference switching circuit.

An input terminal of the display switching circuit accesses a display signal outputted by a source chip-on-film, and a controlled terminal of the display switching circuit is configured to access the control signal, a first output terminal of the display switching circuit is connected to a source of a transistor corresponding to a first portion of the sub-pixel, and a second output terminal of the display switching circuit is connected to a source of a transistor corresponding to a second portion of the sub-pixel.

An input terminal of the reference switching circuit is configured to access a reference voltage, and a controlled terminal of the reference switching circuit is configured to access the control signal, a first output terminal of the reference switching circuit is connected to a reference voltage terminal corresponding to a first portion of the sub-pixel, and a second output terminal of the reference switching circuit is connected to a reference voltage terminal corresponding to a second portion of the sub-pixel.

The gate chip-on-film is configured to connect to the gates of transistors of both portions of each of the sub-pixels.

The control signal causes the display switching circuit to be turned on with the input terminal and the first output terminal thereof being connected, and causes the reference switching circuit to be turned on with the input terminal and the second output terminal thereof being connected; or, the control signal causes the display switching circuit to be turned on with the input terminal and the second output terminal thereof being connected, and causes the reference switching circuit to be turned on with the input terminal and the first output terminal thereof being connected.

The display array is connected to the source chip-on-film and the gate chip-on-film, respectively.

The backlight panel provides a light source to the display array.

In one of the embodiments, the display array comprises a liquid crystal display array.

The technical features of the embodiments described above can be arbitrarily combined. In order to make the description succinct, there is no describing of all possible combinations of the various technical features in the foregoing embodiments. It should be noted that there is no contradiction in the combination of these technical features which should be considered as the scope of the description.

Although the present disclosure is illustrated and described herein with reference to specific embodiments, the present disclosure is not intended to be limited to the details shown. It is to be noted that, various modifications may be made in the details within the scope and range of equivalents of the claims and without departing from the present disclosure. Therefore, the protection scope of the present disclosure shall be subject to the protection scope of the claims.

What is claimed is:

1. A driving circuit, comprising a signal processing circuit and controlled switching circuits, wherein each of the controlled switching circuits corresponds to each sub-pixel, respectively;

the signal processing circuit is configured to access a row start signal of a timing controller, and output a control signal according to the row start signal;

the controlled switching circuit comprises a display switching circuit and a reference switching circuit;

an input terminal of the display switching circuit is configured to access a display signal outputted by a source chip-on-film, and a controlled terminal of the display switching circuit is configured to access the control signal, a first output terminal of the display switching circuit is connected to a source of a transistor corresponding to a first portion of the sub-pixel, and a second output terminal of the display switching circuit is connected to a source of a transistor corresponding to a second portion of the sub-pixel;

an input terminal of the reference switching circuit is configured to access a reference voltage, and a controlled terminal of the reference switching circuit is configured to access the control signal, a first output terminal of the reference switching circuit is connected to a reference voltage terminal corresponding to a first portion of the sub-pixel, and a second output terminal of the reference switching circuit is connected to a reference voltage terminal corresponding to a second portion of the sub-pixel; and the control signal causes the display switching circuit to be turned on with the input terminal and the first output terminal thereof being connected, and causes the reference switching circuit to be turned on with the input terminal and the second output terminal thereof being connected; or, the control signal causes the display switching circuit to be turned on with the input terminal and the second output terminal thereof being connected, and causes the reference switching circuit to be turned on with the input terminal and the first output terminal thereof being connected.

2. The driving circuit according to claim 1, wherein the signal processing circuit comprises a D flip-flop, a first controlled switch, and a second controlled switch;

an input terminal of the first controlled switch is configured to access a logic high level voltage, and an input terminal of the second controlled switch is grounded;

an output terminal of the first controlled switch is configured to access an output terminal of the second controlled switch and is grounded, and the output terminal of the first controlled switch is further configured to output the control signal;

a controlling terminal of the D flip-flop is configured to access the row start signal, an pulse input terminal of the D flip-flop is connected to the output terminal of the first controlled switch, and an output terminal of the D flip-flop is connected to a controlled terminal of the first controlled switch and a controlled terminal of the second controlled switch; and upon the output terminal of the D flip-flop outputting a same logic level voltage, the first controlled switch is turned on with the input terminal and the output terminal thereof being connected; or, the first controlled switch is turned off with the input terminal and the output terminal thereof being disconnected, and the second controlled switch is turned on with the input terminal and the output terminal thereof being connected.

3. The driving circuit according to claim 2, wherein the D flip-flop comprises a rising edge D flip-flop.

4. The driving circuit according to claim 2, wherein the first controlled switch comprises a first P-channel field effect transistor (FET), and the second controlled switch comprises a first N-channel FET;

a controlled terminal of the first controlled switch is a gate of the first P-channel FET; and a controlled terminal of the second controlled switch is a gate of the first N-channel FET.

5. The driving circuit according to claim 2, wherein the signal processing circuit further comprises a protective resistor; and the output terminal of the first controlled switch is grounded through the protective resistor.

6. The driving circuit according to claim 1, wherein the display switching circuit comprises a third controlled switch and a fourth controlled switch;

a controlled terminal of the third controlled switch and a controlled terminal of the fourth controlled switch access the control signal;

an input terminal of the third controlled switch and an input terminal of the fourth controlled switch are the input terminals of the display switching circuit, an output terminal of the third controlled switch is the first output terminal of the display switching circuit, and an output terminal of the fourth controlled switch is the second output terminal of the display switching circuit; and upon the controlled terminals receiving the same control signal, the third controlled switch is turned on with the input terminal and the output terminal thereof being connected, and the fourth controlled switch is turned off with the input terminal and the output terminal thereof being disconnected; or, the third controlled switch is turned off with the input terminal and the output terminal thereof being disconnected, and the fourth controlled switch is turned on with the input terminal and the output terminal thereof being connected.

7. The driving circuit according to claim 6, wherein the third controlled switch comprises a second N-channel field effect transistor (FET), and the fourth controlled switch comprises a second P-channel FET;

a controlled terminal of the third controlled switch is a gate of the second N-channel FET; and a controlled terminal of the fourth controlled switch is a gate of the second P-channel FET.

8. The driving circuit according to claim 1, wherein the reference switching circuit comprises a fifth controlled switch and a sixth controlled switch;

a controlled terminal of the fifth controlled switch and a controlled terminal of the sixth controlled switch access the control signal;

an input terminal of the fifth controlled switch and an input terminal of the sixth controlled switch are the input terminals of the reference switching circuit, an output terminal of the fifth controlled switch is the first output terminal of the reference switching circuit, and an output terminal of the sixth controlled switch is the second output terminal of the reference switching circuit; and upon the controlled terminals receiving the same control signal, the fifth controlled switch is turned on with the input terminal and the output terminal thereof being connected, and the sixth controlled switch is turned off with the input terminal and the output terminal thereof being disconnected; or, the fifth controlled switch is turned off with the input terminal and the output terminal thereof being disconnected, and the sixth controlled switch is turned on with the input terminal and the output terminal thereof being connected.

9. The driving circuit according to claim 8, wherein the fifth controlled switch comprises a second P-channel field effect transistor (FET), and the sixth controlled switch comprises a second N-channel FET;

a controlled terminal of the fifth controlled switch is a gate of the second P-channel FET; and a controlled terminal of the sixth controlled switch is a gate of the second N-channel FET.

10. A display driving device, comprising a timing controller, a source chip-on-film, a gate chip-on-film, and a driving circuit; wherein the timing controller is connected to the source chip-on-film and the gate chip-on-film, respectively;

the driving circuit comprises a signal processing circuit and controlled switching circuits, wherein each of the controlled switching circuits corresponds to each sub-pixel, respectively;

the signal processing circuit is configured to access a row start signal of a timing controller, and output a control signal according to the row start signal;

the controlled switching circuit comprises a display switching circuit and a reference switching circuit;

an input terminal of the display switching circuit accesses a display signal outputted by a source chip-on-film, and a controlled terminal of the display switching circuit is configured to access the control signal, a first output terminal of the display switching circuit is connected to a source of a transistor corresponding to a first portion of the sub-pixel, and a second output terminal of the display switching circuit is connected to a source of a transistor corresponding to a second portion of the sub-pixel;

an input terminal of the reference switching circuit is configured to access a reference voltage, and a controlled terminal of the reference switching circuit is configured to access the control signal, a first output terminal of the reference switching circuit is connected to a reference voltage terminal corresponding to a first portion of the sub-pixel, and a second output terminal of the reference switching circuit is connected to a reference voltage terminal corresponding to a second portion of the sub-pixel; and the gate chip-on-film is configured to connect to gates of transistors of both portions of each of the sub-pixels;

the control signal causes the display switching circuit to be turned on with the input terminal and the first output terminal thereof being connected, and causes the reference switching circuit to be turned on with the input terminal and the second output terminal thereof being connected; or, the control signal causes the display switching circuit to be turned on with the input terminal and the second output terminal thereof being connected, and causes the reference switching circuit to be turned on with the input terminal and the first output terminal thereof being connected.

11. The display driving device according to claim 10, wherein the signal processing circuit comprises a D flip-flop, a first controlled switch, and a second controlled switch;

an input terminal of the first controlled switch is configured to access a logic high level voltage, and an input terminal of the second controlled switch is grounded;

an output terminal of the first controlled switch is connected to an output terminal of the second controlled switch and is grounded, and the output terminal of the first controlled switch is further configured to output the control signal;

a controlling terminal of the D flip-flop is configured to access the row start signal, an pulse input terminal of the D flip-flop is connected to the output terminal of the first controlled switch, and an output terminal of the D flip-flop is connected to a controlled terminal of the first controlled switch and a controlled terminal of the second controlled switch; and upon the output terminal of the D flip-flop outputting a same logic level voltage, the first controlled switch is turned on with the input terminal and the output terminal thereof being connected, and the second controlled switch is turned off with the input terminal and the output terminal thereof being disconnected; or, the first controlled switch is turned off with the input terminal and the output terminal thereof being disconnected, and the second controlled switch is turned on with the input terminal and the output terminal thereof being connected.

12. The display driving device according to claim 11, wherein the D flip-flop comprises a rising edge D flip-flop.

13. The display driving device according to claim 11, wherein the first controlled switch comprises a first P-channel FET, and the second controlled switch comprises a first N-channel FET;

a controlled terminal of the first controlled switch is a gate of the first P-channel FET; and a controlled terminal of the second controlled switch is a gate of the first N-channel FET.

14. The display driving device according to claim 11, wherein the signal processing circuit further comprises a protective resistor; and the output terminal of the first controlled switch is grounded through the protective resistor.

15. The display driving device according to claim 10, wherein the display switching circuit comprises a third controlled switch and a fourth controlled switch;

a controlled terminal of the third controlled switch and a controlled terminal of the fourth controlled switch access the control signal;

an input terminal of the third controlled switch and an input terminal of the fourth controlled switch are the input terminals of the display switching circuit, an output terminal of the third controlled switch is the first output terminal of the display switching circuit, and an output terminal of the fourth controlled switch is the second output terminal of the display switching circuit; and upon the controlled terminals receiving the same control signal, the third controlled switch is turned on with the input terminal and the output terminal thereof being connected, and the fourth controlled switch is turned off with the input terminal and the output terminal thereof being disconnected; or, the third controlled switch is turned off with the input terminal and the output terminal thereof being disconnected, and the fourth controlled switch is turned on with the input terminal and the output terminal thereof being connected.

16. The display driving device according to claim 15, wherein the third controlled switch comprises a second N-channel FET, and the fourth controlled switch comprises a second P-channel FET;

a controlled terminal of the third controlled switch is a gate of the second N-channel FET; and a controlled terminal of the fourth controlled switch is a gate of the second P-channel FET.

17. The display driving device according to claim 10, wherein the reference switching circuit comprises a fifth controlled switch and a sixth controlled switch;

a controlled terminal of the fifth controlled switch and a controlled terminal of the sixth controlled switch access the control signal;

an input terminal of the fifth controlled switch and an input terminal of the sixth controlled switch are the input terminals of the reference switching circuit, an output terminal of the fifth controlled switch is the first output terminal of the reference switching circuit, and an output terminal of the sixth controlled switch is the second output terminal of the reference switching circuit; and upon the controlled terminals receiving the same control signal, the fifth controlled switch is turned on with the input terminal and the output terminal thereof being connected, and the sixth controlled switch is turned off with the input terminal and the output terminal thereof being disconnected; or, the fifth controlled switch is turned off with the input terminal and the output terminal thereof being disconnected, and the sixth controlled switch is turned on with the input terminal and the output terminal thereof being connected.

18. The display driving device according to claim 17, wherein the fifth controlled switch comprises a second P-channel FET, and the sixth controlled switch comprises a second N-channel FET;

a controlled terminal of the fifth controlled switch is a gate of the second P-channel FET; and a controlled terminal of the sixth controlled switch is a gate of the second N-channel FET.

19. A display device, comprising a display driving device, a backlight panel, and display array;

wherein the display driving device comprises a timing controller, a source chip-on-film, a gate chip-on-film, and a driving circuit; wherein the timing controller is connected to the source chip-on-film and the gate chip-on-film, respectively;

the driving circuit comprises a signal processing circuit and controlled switching circuits, wherein each of the controlled switching circuits corresponds to each sub-pixel, respectively;

the signal processing circuit is configured to access a row start signal of a timing controller, and output a control signal according to the row start signal;

the controlled switching circuit comprises a display switching circuit and a reference switching circuit;

an input terminal of the display switching circuit accesses a display signal outputted by a source chip-on-film, and a controlled terminal of the display switching circuit is configured to access the control signal, a first output terminal of the display switching circuit is connected to a source of a transistor corresponding to a first portion of the sub-pixel, and a second output terminal of the display switching circuit is connected to a source of a transistor corresponding to a second portion of the sub-pixel;

an input terminal of the reference switching circuit is configured to access a reference voltage, and a controlled terminal of the reference switching circuit is configured to access the control signal, a first output terminal of the reference switching circuit is connected to a reference voltage terminal corresponding to a first portion of the sub-pixel, and a second output terminal of the reference switching circuit is connected to a reference voltage terminal corresponding to a second portion of the sub-pixel; and the gate chip-on-film is configured to connect to gates of transistors of both portions of each of the sub-pixels;

the control signal causes the display switching circuit to be turned on with the input terminal and the first output terminal thereof being connected, and causes the reference switching circuit to be turned on with the input terminal and the second output terminal thereof being connected; or, the control signal causes the display switching circuit to be turned on with the input terminal and the second output terminal thereof being connected, and causes the reference switching circuit to be turned on with the input terminal and the first output terminal thereof being connected;

the display array is connected to the source chip-on-film and the gate chip-on-film, respectively;

the backlight panel is configured to provide a light source to the display array.

20. The display device according to claim 19, wherein the display array comprises a liquid crystal display array.

* * * * *